US005295281A

United States Patent [19]

Kordes

[11] Patent Number: 5,295,281

[45] Date of Patent: Mar. 22, 1994

[54] GUIDING SYSTEM HAVING A TROLLEY FOR MOVING SUSPENDED DOOR PANELS AND THE TROLLEY

[75] Inventor: Herbert Kordes, Bad Salzuflen, Fed. Rep. of Germany

[73] Assignee: Dorma GmbH & Co. KG, Ennepetal, Fed. Rep. of Germany

[21] Appl. No.: 886,959

[22] Filed: May 21, 1992

Related U.S. Application Data

[63] Continuation-in-part of International Application No. PCT/DE91/00817, filed Oct. 18, 1992.

[30] Foreign Application Priority Data

Dec. 27, 1990 [DE] Fed. Rep. of Germany ..... 4041925

[51] Int. Cl.[5] ..... A47H 11/04; A47H 15/00; E05D 15/06

[52] U.S. Cl. ..... 16/95 R; 16/104

[58] Field of Search ..... 16/95 R, 104

[56] References Cited

U.S. PATENT DOCUMENTS 1,889,112 11/1932 Shoemaker .
2,148,515 2/1939 Taylor ..... 16/104
2,503,848 4/1950 Smith, Jr. ..... 16/95
4,752,987 6/1988 Dreyer et al. ..... 16/102

FOREIGN PATENT DOCUMENTS 2108593 9/1972 Fed. Rep. of Germany .
7247479 12/1972 Fed. Rep. of Germany .
2145793 3/1973 Fed. Rep. of Germany .
0336213 4/1977 Fed. Rep. of Germany .
3148464 12/1982 Fed. Rep. of Germany .
3522824 8/1986 Fed. Rep. of Germany .
8909320 10/1989 PCT Int'l Appl. .

*Primary Examiner*—W. Donald Bray
*Assistant Examiner*—Carmine Cuda
*Attorney, Agent, or Firm*—Nils H. Ljungman & Associates

[57] ABSTRACT

This invention relates to a support and guide element for movable, suspended door and wall elements. The support and guide element is designed so that a smooth movement can be securely executed, even in the vicinity of junctions and intersections. This is achieved because four support rollers are fastened to a square support roller cage block, but where only two of the four support rollers support the weight of the door or wall element in the running direction of the door or wall element. The other two support rollers are oriented at right angles to the running direction, and, during movement of the door in the running direction, only come into contact with the roller rail at a junction or intersection. Above the running rollers there are guide rollers, which guarantee secure guidance of the wall element.

20 Claims, 5 Drawing Sheets

GUIDING SYSTEM HAVING A TROLLEY FOR MOVING SUSPENDED DOOR PANELS AND THE TROLLEY

This application is a continuation-in-part application of International Application No. PCT/DE91/00817, filed on Oct. 18, 1992, which designated the U.S. and which claims priority under 35 U.S.C. §119 from Federal Republic of Germany Patent Application No. P 40 41 925, filed on Dec. 27, 1990.

BACKGROUND OF THE INVENTION

1. Field of the Invention

This invention relates to a support and guide element for the sliding movement of door and wall elements that are suspended from a stationary roller rail. The door or wall elements are mounted, for example, by means of a truck or trolley which is guided in a system of roller rails fastened to the ceiling. The ceiling rails are designed such that the support or guide element is disposed inside the roller rail. The roller rail further comprises a recess running along its bottom side, wherein the shaft of the support and guide element projects through the recess and is fixedly connected to the door or wall element located therebelow. The running surfaces for the truck or trolley are generally the bottom inside surface of the roller rail. In addition, to impart a greater degree of stability to the truck or trolley, lateral guidance of the trolley within the roller rail should also be provided either by guide pins or guide rollers. These guide rollers or guide pins can generally be disposed above the support rollers and contact the side walls of the roller rail.

2. Background Information

One example of a support and guide element for a movable or sliding door or wall is disclosed in German Patent No. 21 45 793. Two co-planar pairs of rollers are employed, which have the same clear distance from one another and fill up the width of the rail. There are also means which guarantee that the support body is sufficiently supported in the vicinity of the intersection of two rails. The roller pair is oriented symmetrically in relation to the trunnions. But beyond a certain point, such a configuration may result in the support rollers slipping out of the guide rails.

Another example of a support and guide element is disclosed in U.S. Pat. No. 1,889,112. This United States patent discloses the design of an arrangement of support and guide rollers, wherein the support and guide rollers are oriented symmetrically around a pivot.

As another example, German Patent No. 35 22 824 also discloses a support and guide system for movable door or wall elements. In this German patent, the trolley is preferably equipped with eight support rollers. The trolley is guided by head rollers, which are mounted on vertical axles, in conjunction with guide means, which are located on the ceiling rail. In addition, spheres which can rotate in all directions are used as support elements, which spheres guarantee that the support rollers move in the running direction and provide linear guidance of the trolley in the rail junction areas. The overall design and construction of this trolley is very complex, and thus is not an economical solution.

As a final example, German Utility Model 72 47 479 discloses a support and guide element mounted in the center so that it can rotate. The support and guide element is equipped with four support rollers and three guide rollers. As a result of the trolley mounting being located in the center, a particularly complex support element is necessary to guarantee a smooth movement of the support element at the junctions of the roller rails.

All known support and guide elements have decisive disadvantages, which disadvantages can be summed up by noting that it is precisely at the junctions or intersections that smooth motion and thus a user-friendly operation is unobtainable. Further, it is precisely in these areas where, when the wall element is moved, a locking of the support rollers occurs. This locking may be attributed, to some extent, to the fact that the guide system formed by support rollers and guide rollers does not function smoothly when crossing a junction.

OBJECT OF THE INVENTION

The object of the invention is therefore to create a support and guide element which is simple, economical to manufacture, runs very smoothly, offers the maximum possible ease of operation for the user, and also operates correctly and smoothly in the vicinity of junctions and intersections of the guide rails.

SUMMARY OF THE INVENTION

The object of the invention is achieved in that there are preferably four support rollers on a centrally-mounted, rotatable support roller cage. The support roller cage can preferably have a square base surface and four vertical side surfaces which are perpendicular to the square base surface and extend therefrom. One of the four support rollers should be positioned on each vertical side surface. Further, each support roller is preferably placed eccentrically on a side surface such that the outside radius of the rollers projects beyond the lateral edges of the square cage. As a result of such a configuration, only the two of the four rollers which are positioned in parallel to the direction of travel of the support roller cage are used at any given time to allow ease of movement of the roller cage within the roller rail of the guide system. Additionally, the two support rollers which are not employed are maintained at essentially right angles to the direction of travel of the support cage. Preferably, the support rollers can be equipped with ball bearings having a plastic casing.

The support rollers can be provided with additional lateral guidance by four guide rollers. The guide rollers are preferably disposed above the support rollers and provide the support element with lateral guidance inside the roller rail. Thus, as a result of these features, the support element can travel smoothly and quietly along the roller rail.

One aspect of the invention resides broadly in a guiding system for moving suspended panels, the panels being fixedly connected to a trolley and the trolley running on a track, the track having a first track portion, a second track portion transverse to and intersecting the first track portion, a running surface, and an opening disposed in the bottom of the track. The guiding system further comprises: four support rollers disposed on the trolley for supporting the trolley from the track, the trolley comprising a roller cage for supporting the four support rollers and having at least one side surface with sides, and the sides comprising two sets of opposite sides. The four support rollers are mounted on at least one side surface of the roller cage, wherein each of the four support rollers is disposed on a corresponding horizontal axle for rotating freely about the corresponding horizontal axle. The four support rollers comprise two pairs of support rollers wherein one pair of the two pairs of support rollers is disposed on opposite sides of each set of opposite sides of the roller cage, each side having a vertical edge portion. Each of the four support rollers is disposed on its corresponding side and projects substantially beyond the corresponding vertical edge portion of its corresponding side. Each support roller of each pair of support rollers is for rotating about an axis of rotation, the axes of each pair of support rollers being parallel and displaced a substantial distance from one another, and each pair of support rollers for making contact with and running on the running surface of the track.

Another aspect of the invention resides broadly in a trolley for a guiding system for moving suspended panels fixedly connected to the trolley running on a track having a first track portion, a second track portion transverse to and intersecting the first track portion, a running surface and an opening disposed in the bottom of the track. The trolley further comprises: four support rollers, a roller cage for supporting the four support rollers and having at least one side surface with sides, and the sides comprising two sets of opposite sides. The four support rollers are mounted on at least one side surface of the roller cage, wherein each of the four support rollers is disposed on a corresponding axle for rotating freely about the corresponding axle. The four support rollers comprise two pairs of support rollers wherein one pair of the two pairs of support rollers is disposed on opposite sides of each set of opposite sides of the roller cage, each side having a vertical edge portion. Each of the four support rollers is disposed on its corresponding side and projects substantially beyond the corresponding vertical edge portion of its corresponding side, the support roller of each pair of support rollers for rotating about an axis of rotation, the axes of each pair of support rollers being parallel and displaced a substantial distance from one another, each pair of support rollers for making contact with and running on the running surface of the track.

Yet another aspect of the invention resides broadly in a trolley for a guiding system for moving suspended panels fixedly connected to the trolley running on a track having a first track portion, a second track portion transverse to and intersecting the first track portion, a running surface and an opening disposed in the bottom of the track. The trolley further comprises: solely four support rollers, a roller cage for supporting the four support rollers and having at least one side surface with sides, and the sides comprising two sets of opposite sides. The four support rollers are mounted on at least one side surface of said roller cage, wherein each of the four support rollers is disposed on a corresponding axle for rotating freely about the corresponding axle. The four support rollers comprise solely two pairs of support rollers wherein one pair of the two pairs of support rollers is disposed on opposite sides of each set of opposite sides of the roller cage, each side having a vertical edge portion. Each of the four support rollers is disposed on its corresponding side and projecting substantially beyond the corresponding vertical edge portion of its corresponding side, the support roller of each pair of support rollers for rotating about an axis of rotation, the axes of each pair of support rollers being parallel and displaced a substantial distance from one another, each pair of support rollers for making contact with and running on the running surface of the track.

BRIEF DESCRIPTION OF THE DRAWINGS

The invention is explained below in greater detail, with reference to the embodiment which is schematically illustrated in the accompanying drawings, in which.

DESCRIPTION OF THE PREFERRED EMBODIMENTS

Figure 1:
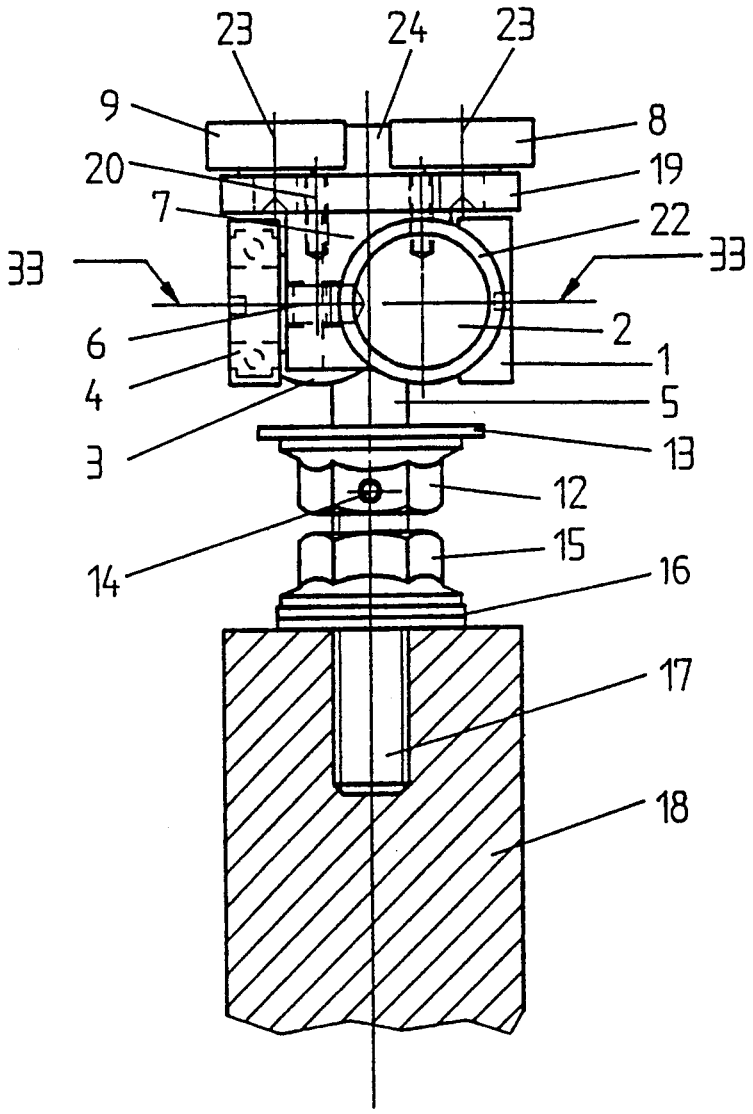
FIG. 1 is a side view, without a roller rail, of a trolley with a door or wall element suspended therefrom.

FIG. 1 illustrates a wall or door element 18 suspended from a support and guide element or trolley. Preferably, the wall element 18 can be permanently fastened to the trolley by means of a threaded shaft or rod 17 and a lock washer 16 with a lock nut 15, while other fastening means can also be used. The support and guide element, or trolley, preferably has a support roller cage 7 and support rollers 1, 2, 3, and 4. The base surface of support roller cage 7 can preferably be in the form of a square block. The square block configuration of roller cage 7 allows for an arrangement of the support rollers 1, 2, 3, and 4 wherein the object specified by the invention, that is, smooth continuous motion of the wall or door element, may be accomplished.

Figure 2:
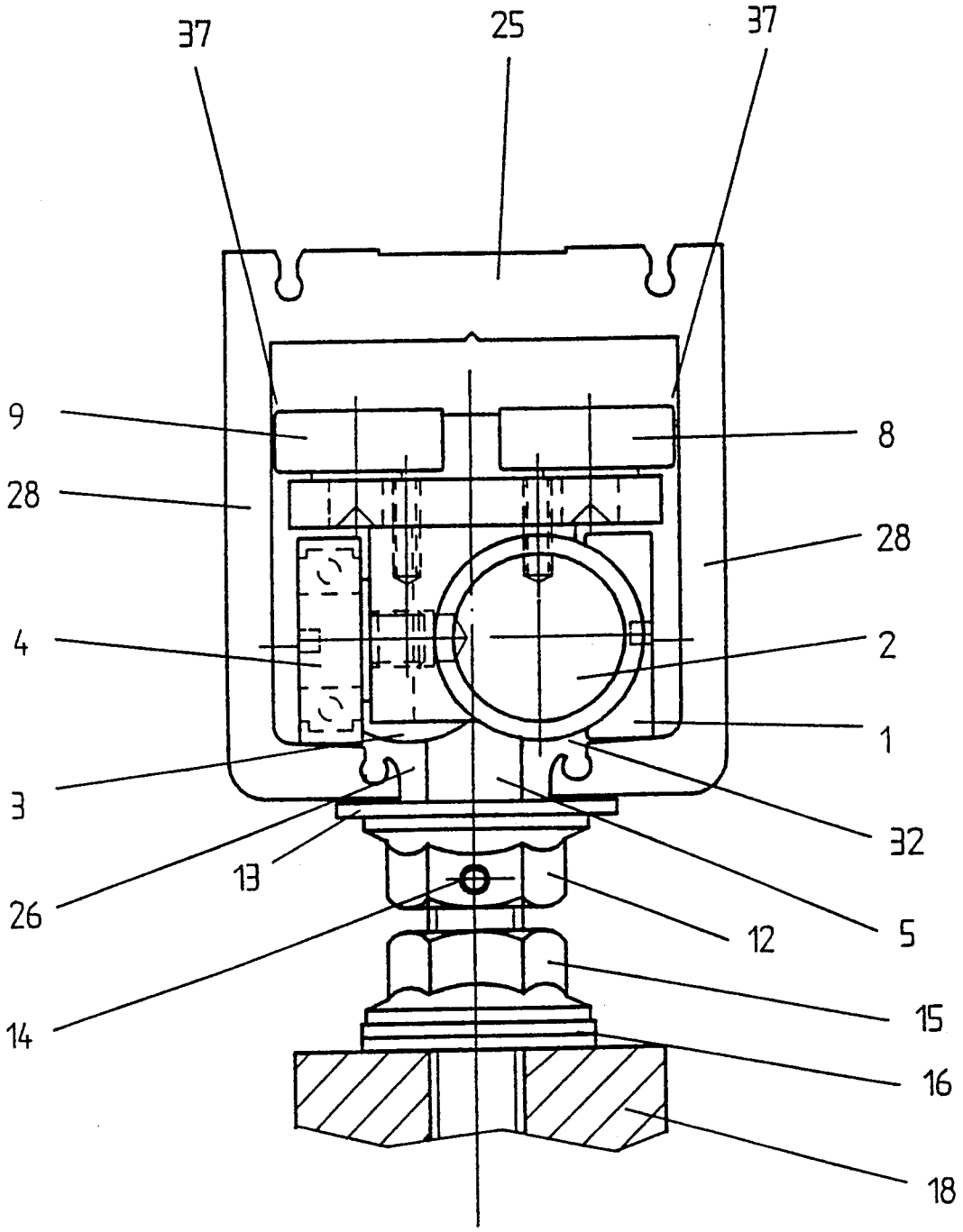
FIG. 2 shows a similar view to that of FIG. 1, but also shows a roller rail.

FIG. 2 illustrates a wall or door element 18 suspended from a trolley wherein the trolley is shown mounted in roller running rail 25. FIG. 2 further shows washer 13, nut 12, and safety bolt 14 which can provide additional stability during operation as explained below. As illustrated in FIG. 2, washer 13, nut 12, and safety bolt 14 may be positioned so as to prevent excessive vertical movement of wall or door element 18. More specifically, washer 13 may be held in place by nut 12 and bolt 14, thereby preventing the entire assembly from moving upwardly, and thus eliminating any tendency of the wall element 18 to "bounce" up and down. Such "bouncing" motion of the door or wall element 18 may result in damage to the support rollers 1, 2, 3, and 4 or possibly any other components of the trolley. Preferably, a play or clearance is provided between washer 13 and the underside of roller rail 25 so that essentially no friction is created therebetween, which friction would prevent smooth, free movement of the door or wall element 18 along roller rail 25.

Figure 3:
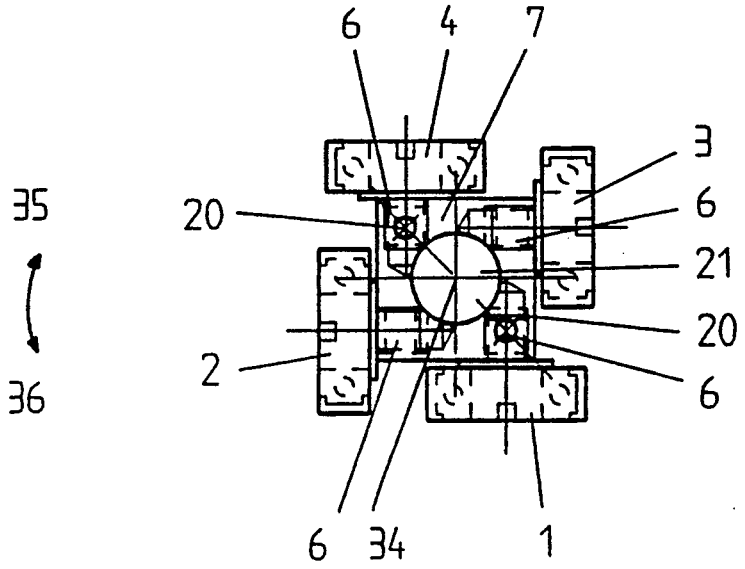
FIG. 3 shows a cross section of the support roller cage and support roller arrangement.

In one embodiment of the present invention, as illustrated in FIG. 3, the square base surface of roller cage 7 can be pierced, in the vertical direction, by a hole 21. A shaft 5, shown in FIG. 1, can project through hole 21 in roller cage 7 and can preferably be easily rotatable therein. Further illustrated in FIG. 1, one end of shaft 5 can preferably be braced in a shaft head 24, wherein shaft head 24 can preferably be disposed above the mechanism plate 19 for guide rollers 8 and 9. The other end of the shaft 5, which can preferably be threaded, can extend downwardly and can be received in the wall or door element 18. It should be noted that other fastening means may also easily be employed.

FIG. 3 shows support rollers 1, 2, 3, and 4 fastened on the vertical side surfaces of the support roller cage 7, preferably by means of horizontal axles 6. FIG. 1 essentially illustrates the same configuration wherein support rollers 1, 2, 3 and 4 are fastened to support roller cage 7 by means of the horizontal axles 6, wherein the horizontal axles 6 lie in plane 33 thus enabling support rollers 1, 2, 3, and 4 to freely rotate. The fastening of the support rollers 1, 2, 3 and 4 can preferably be done so that on the vertical outer sides of the support roller cage 7, the axles can be placed outside the center axis to either the left or the right of the center axis. In other words, and as shown in FIG. 3, each horizontal axle 6 can preferably be positioned perpendicularly to the vertical side surface through which the axle passes, while each axle also preferably is not directed towards center axis 34. Thus, each support roller 1, 2, 3, and 4 is essentially mounted off-center wherein horizontal axles 6 do not pass through the center points of the vertical side surfaces.

Further, the support roller cage 7 and the support rollers 1, 2, 3 and 4 can preferably be of appropriate dimensions such that one support roller may be positioned on each side surface of the support roller cage 7 without engaging in contact with any other support roller. Preferably, as a result of this arrangement, only two of the four support rollers, either pair 1 and 4, or pair 2 and 3 respectively, are in offset engagement with roller rail 25 in the direction of travel. Thus, at any given time, only the two support rollers which are disposed in parallel to the direction of travel (roller pair 1 and 4 in FIG. 2) support substantially all of the weight of the door element 18. The two non-load-bearing support rollers, that is, the other pair of either pair 1 and 4, or pair 2 and 3, (roller pair 2 and 3 in FIG. 2) are preferably at right angles to the direction of travel and, in this configuration, are preferably not in contact with the running rail 25.

Figure 4:
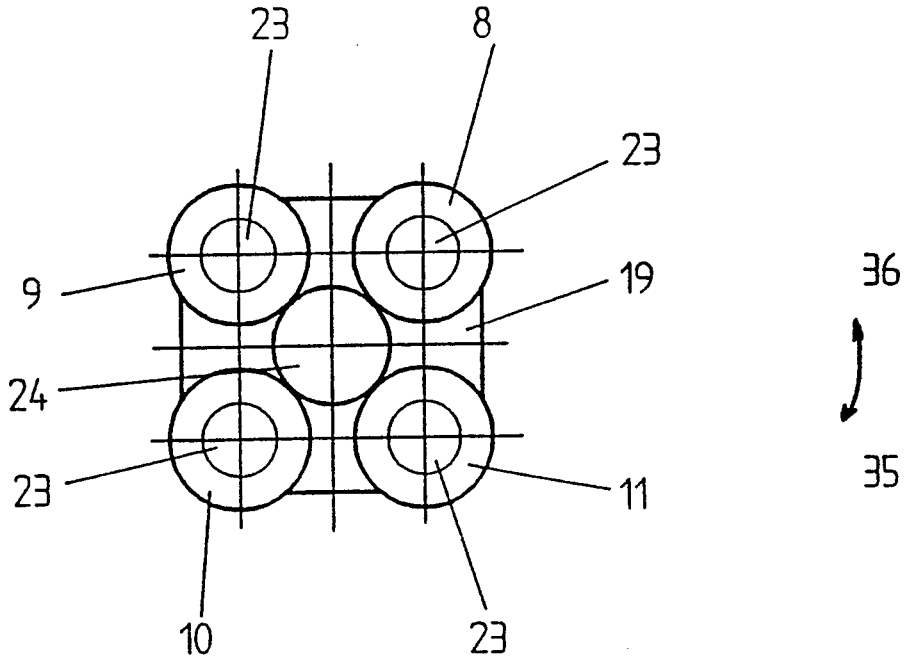
FIG. 4 is a plan view of a trolley, showing the guide roller arrangement.

Preferably, the trolley can be laterally guided by four guide rollers 8, 9, 10, and 11 as shown in FIG. 4. Guide rollers 8 and 9 are also illustrated in FIG. 1. The guide rollers can preferably be positioned above the support roller cage 7, and can preferably be disposed on mechanism plate 19, to which mechanism plate 19 the guide rollers 8, 9, 10, and 11 can be fastened by vertical axles 23. The mechanism plate 19 for the guide rollers can preferably be connected to the support roller cage 7 by means of connecting means 20, wherein connecting means 20 can be bolts, for example. However, the mechanism plate 19 and roller cage 7 can also possibly be manufactured from one piece. As shown in FIG. 4, guide rollers 8, 9, 10, and 11 can be positioned such that each guide roller extends beyond the outside corners of the mechanism plate 19. Thus, each guide roller should essentially have a radius greater than the distance from its vertical axle 23 to the edge of mechanism plate 19. Additionally, one guide roller should generally be located at each of the outer corners of the mechanism plate 19. As shown in FIG. 2, guide rollers 8, 9, 10, and 11 laterally guide the trolley along roller rail 25.

Figure 5:
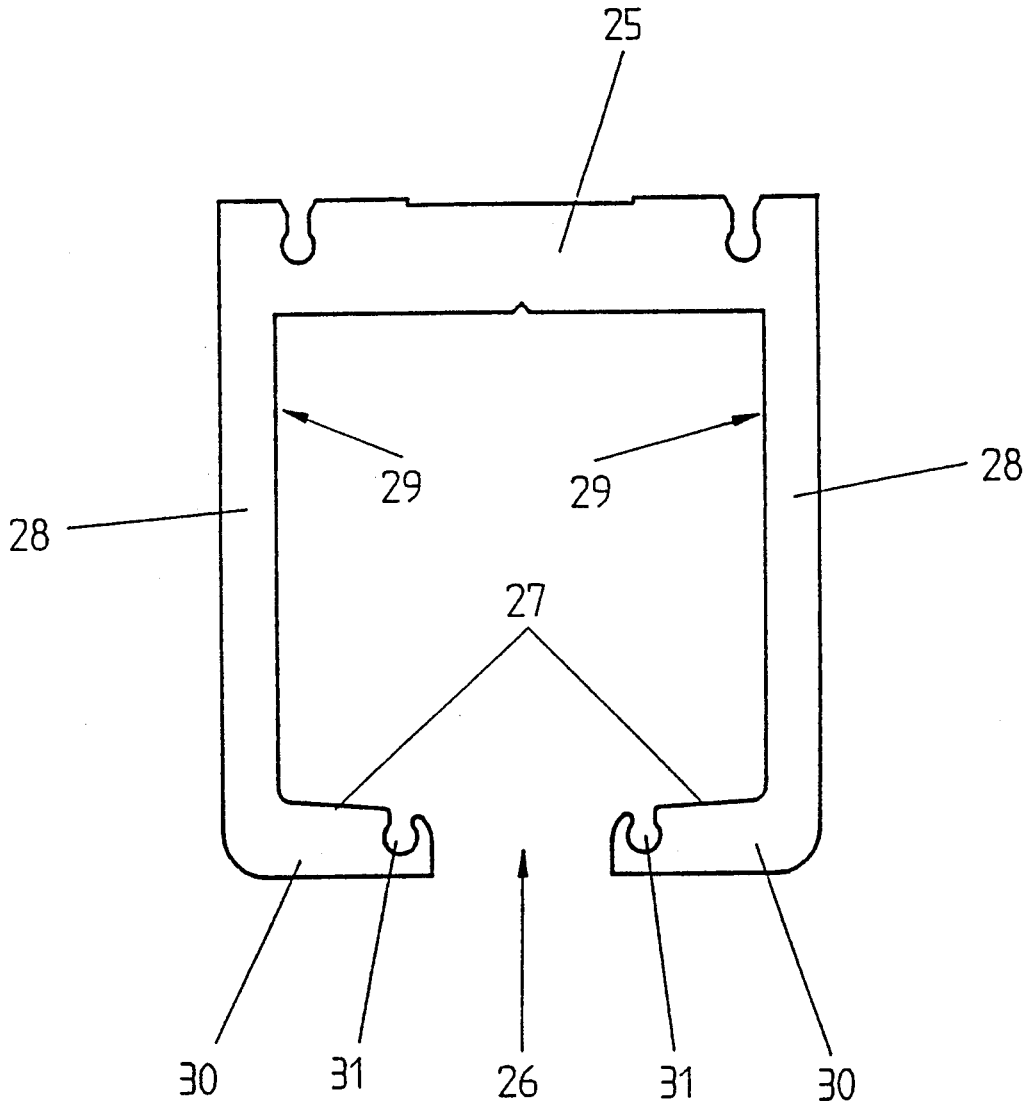
FIG. 5 is a transverse sectional view of a roller rail.

FIG. 5 shows running rail 25 with legs 30 and grooves or channels 31 disposed on the lower portion thereof. The load-bearing support rollers, which as previously discussed, can be either pair 1 and 4 or pair 2 and 3, preferably engage in and maintain contact with the running rail 25 on the support roller running surface 27 of legs 30. Legs 30 of running rail 25 are preferably angled downwardly and form guide recess 26 therebetween. Due to this configuration, the non-load-bearing support rollers, oriented perpendicularly to the direction of travel, can remain free from contact with the running rail 25. This arrangement of the support rollers in relation to the running rail 25 is illustrated in FIG. 2. In FIG. 2, support rollers 1 and 4 are in contact with the support roller running surface 27 of roller rail 25. Additionally, support rollers 2 and 3, which are disposed perpendicularly to the direction of travel, do not engage in contact with roller rail 25 due to guide recess 26.

Figure 6:
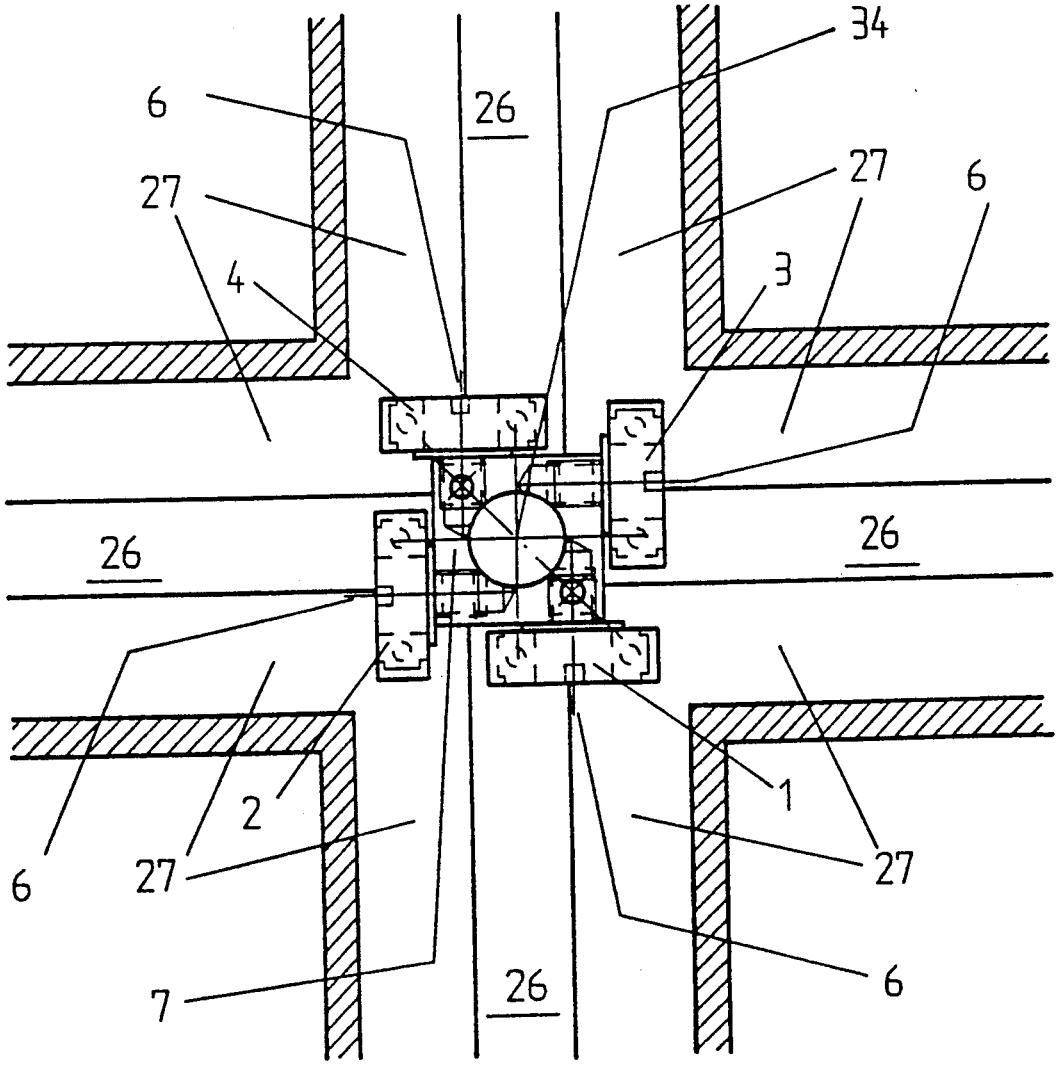
FIG. 6 is a cross sectional view of a trolley on a roller rail, seen from above, at an intersection of the roller rails.

Also illustrated in FIG. 5, roller rail 25 comprises side legs 28. Guide roller running surfaces 29 are provided by the inner sides of side legs 28. Thus, guide rollers 8, 9, 10, and 11, disposed on the outer corners of mechanism plate 19, are configured to contact guide roller running surfaces 29 of roller rail 25 and thereby laterally guide the trolley through roller rail 25. In the present invention, as a wall or door element 18 is moved in the longitudinal direction, preferably only two support rollers, either pair 1 and 4 or pair 2 and 3, are used. However, as depicted in FIG. 6, when the door 18 is pushed over a junction or an intersection, the two previously non-load-bearing support rollers also bear at least some of the weight of the door. In order to guarantee a smooth motion of the door element and trolley across the junction or intersection, the support rollers can preferably be disposed in an off-set or off-center configuration. Thus, horizontal axles 6 of the support rollers 1, 2, 3 and 4 are outside the center axis 34 of the support roller cage 7. In other words, two support rollers disposed on opposite sides of the roller cage 7, specifically either roller pair 1 and 4 or roller pair 2 and 3, preferably do not share a common axis, nor is any axle 6 directed towards center axis 34.

In contrast to the present invention, if each support roller was centered on its corresponding vertical side surface, and thus each horizontal axle was directed towards center axis 34, when the assembly arrived at a junction or intersection, each support roller would, essentially, simultaneously slip downwardly into guide recess 26. Consequently, a portion of each support roller would become substantially lodged in its corresponding guide recess or possibly even slip out of the roller rail 25, thereby causing the trolley to derail. This situation would constitute a malfunction which would substantially interfere with or prevent the correct smooth operation of the movement of wall elements. The example illustrated in FIG. 6 clearly shows that the present invention, as presented herein, would not result in a similar problem.

In another embodiment of the present invention, two or more trolleys may be employed to support a door or wall segments 18, as for example may be required for larger door or wall segments. Similar to the illustration of FIG. 2, wherein one trolley is employed, it would also be understood that when two or more trolleys are employed, only one pair of support rollers from each trolley will support the door or wall element 18 during movement of the trolley or trolleys in the longitudinal direction of the roller rail 25. Thus, if two or more trollies are used, each trolley having a configuration similar to that of FIG. 2, wherein each trolley is disposed on roller rail 25 at some distance behind another trolley, only support rollers 1 and 4 of each trolley would support the weight of the wall element 18 located beneath them during movement of the door in a first forward direction. The support rollers 2 and 3 of each trolley, which are at right angles to the direction of travel, would not contact the running surfaces 27 because legs 30 are preferably angled downward from the roller rail 25. Between the support rollers 2 and 3, there is preferably a clearance 32, which prevents the support rollers 2 and 3, oriented at right angles to the direction of travel, from coming into contact with the roller rail during longitudinal movements of the trolley on support rollers 1 and 4. Only when there is a pivoting movement at a junction or an intersection are the other support rollers used.

In other words, during movement of the trolley in a first direction, the support rollers which are disposed at right angles to the first direction of travel are used for support essentially only during passage over an intersection of track. However, in the event of a change in the direction of travel, more specifically, when the trolley makes a 90 degree turn at an intersection of the track, the previously non-load-bearing support rollers disposed at right angles to the first direction of travel become the load-bearing support rollers disposed parallel to the second direction of travel. Likewise, the previously load-bearing support rollers disposed parallel to the first direction of travel become the non-load-bearing support rollers disposed at right angles to the second direction of travel wherein they would essentially be employed as the trolley passes over an intersection or in the event of another 90 degrees change in direction of movement.

Additionally, lateral guidance of the support and guide element or trolley is accomplished by means of the guide rollers 8, 9, 10 and 11. As illustrated in FIG. 2, it will be noted that there is preferably a clearance 37 between guide rollers 8, 9, 10 and 11 and the guide roller running surface 29. Guide roller running surface 29, as illustrated in FIG. 5, is essentially the inner side of legs 28 of running rail 25. This clearance eliminates friction between the guide rollers and the guide roller running surface to facilitate easy, smooth running. The guide rollers 8, 9, 10 and 11 can preferably be made of plastic, thereby preventing excessive noise.

One feature of the invention resides broadly in a support and guide element for the movement of movable, hanging door or wall elements, which are connected in stationary, box girder roller rails with junctions and intersections by means of a continuous opening on the bottom in at least two points to the door or wall element located underneath, whereby the support rollers equipped with horizontal axles can be moved inside the roller rail, and the guide rollers equipped with vertical axles are braced against the vertical side leg of the roller rail, and the entire support and guide element can be rotated around a central axle, and there are four support rollers and four guide rollers, whereby two of the four support rollers are always oriented at right angles to the running direction of the roller rail, and when the door and wall element is moved to a junction or an intersection, the previously non-load-bearing support rollers are engaged, characterized by the fact that the support rollers 1, 2, 3 and 4 are mounted so that they can rotate in a support roller cage 7 having a square base surface, each offset from the center of the axle 34 and from one another, near the vertical outside edge, by means of horizontal axles 6, and project beyond the respective vertical outside edge.

Another feature of the invention resides broadly in a support and guide element, characterized by the fact that the support rollers 1, 2, 3 and 4 are made of ball bearings encased in plastic on the running surfaces 22.

Yet another feature of the invention resides broadly in a support and guide element, characterized by the fact that the guide rollers 8, 9, 10 and 11 are arranged above the support rollers 1, 2, 3 and 4 so that in the running direction, all the guide rollers 8, 9, 10 and 11 are always in use.

Still another feature of the invention resides broadly in a support and guide element, characterized by the fact that the recess 26 between the running surfaces 27 of the support rollers is sized so that only the load-bearing support rollers 1 and 4 or 2 and 3 offset in the direction of travel of the roller rail 25 are in contact with the running surface 27.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A guiding system for moving suspended panels, the panels being fixedly connected to a trolley and said trolley running on a track, the track having a first track portion, a second track portion transverse to and intersecting the first track portion, and the track having a running surface and an opening disposed in a bottom portion of the track, the opening having a width, said guiding system further comprising:

four support rollers disposed on said trolley;

said trolley comprising a roller cage for supporting said four support rollers and having at least one side surface with sides, said sides comprising two sets of opposite sides;

said four support rollers being mounted on said at least one side surface of said roller cage, wherein each of said four support rollers is disposed on a corresponding horizontal axle for rotating freely about said corresponding horizontal axle;

said four support rollers comprising two pairs of support rollers wherein one pair of said two pairs of support rollers is disposed on said opposite sides of each said set of opposite sides of said roller cage;

each said side having a corresponding vertical edge portion;

each of said four support rollers being mounted on a corresponding one of said sides;

each said support roller of each said pair of support rollers being configured for rotating about an axis of rotation;

a substantial portion of each of said four support rollers projecting, in a radial direction of each said support roller, beyond the corresponding vertical edge portion of its corresponding side, the radial direction being defined in a direction perpendicular to said axis of rotation of each said support roller and perpendicular to the corresponding vertical edge portion;

another portion of each of said four support rollers diametrically opposed to said substantial portion intersects with a plane which is coaxial with a vertical center axis of said roller cage and normal to said corresponding one of said sides;

said axes of rotation of each said pair of support rollers being parallel and displaced a substantial distance from one another; and each said pair of support rollers being configured for making contact with and running on the running surface of the track.

2. The system of claim 1, wherein:

each said support roller defines a path of travel along the track;

a substantial portion of each said support roller projects, in a radial direction of each said support roller, beyond the corresponding vertical edge portion of its corresponding side and into the path of travel of a support roller of a different side, the radial direction being defined in a direction perpendicular to the axis of rotation of each said support roller and perpendicular to the corresponding vertical edge portion;

each said support roller having an outer diameter;

each said side surface of said roller cage having a length in the direction of travel of its corresponding mounted roller; and said outer diameter of each said support roller being substantially similar to the length of the side surface on which it is mounted.

3. The system of claim 2, wherein said support rollers of each said pair of support rollers are disposed diagonally opposite one another on said roller cage.

4. The system of claim 3, wherein said trolley further comprises guiding means for laterally guiding said trolley.

5. The system of claim 4, wherein the track has a guiding surface, and said guiding means comprises at least four guide rollers for making contact with and running on the guiding surface of the track.

6. The system of claim 5, comprising mounting means for supporting said at least four guide rollers and wherein:

said at least four guide rollers are mounted on said mounting means;

each of said at least four guide rollers is disposed on a corresponding vertical axle for rotating freely about said corresponding vertical axle; and said mounting means is disposed on said roller cage.

7. The system of claim 6, wherein:

said roller cage comprises a square base and four side portions extending from said square base;

said system further comprises stop means for restricting vertical movement of said trolley with respect to the track;

said trolley comprises a shaft which extends through the opening disposed in the bottom of the track, the opening having a width, and said shaft for being fixedly connected to the suspended panel;

said stop means comprises a washer;

said washer is positioned directly below the track and has a dimension greater than the width of the opening disposed in the bottom of the track;

said washer is secured on said shaft by fastening means;

said fastening means comprises a nut and a screw;

said mounting means comprises a square plate;

each of said four guide rollers is disposed in a corner of said square plate; and said mounting means is disposed on said roller cage.

8. A trolley for a guiding system for moving suspended panels fixedly connected to said trolley running on a track having a first track portion, a second track portion transverse to and intersecting the first track portion, a running surface and an opening disposed in a bottom portion of the track, the opening having a width, said trolley further comprising:

four support rollers;

a roller cage for supporting said four support rollers and having at least one side surface with sides, said sides comprising two sets of opposite sides;

said four support rollers being mounted on said at least one side surface of said roller cage, wherein each of said four support rollers is disposed on a corresponding axle for rotating freely about said corresponding axle;

said four support rollers comprising two pairs of support rollers wherein one pair of said two pairs of support rollers is disposed on said opposite sides of each said set of opposite sides of said roller cage;

each said side having a corresponding vertical edge portion;

each of said four support rollers being mounted on a corresponding one of said sides;

each said support roller of each said pair of support rollers being configured for rotating about an axis of rotation;

a substantial portion of each of said four support rollers projecting, in a radial direction of each said support roller, beyond the corresponding vertical edge portion of its corresponding side, the radial direction being defined in a direction perpendicular to said axis of rotation of each said support roller and perpendicular to the corresponding vertical edge portion;

another portion of each of said four support rollers diametrically opposed to said substantial portion intersects with a plane which is coaxial with a vertical center axis of said roller cage and normal to said corresponding one of said sides;

said axes of rotation of each said pair of support rollers being parallel and displaced a substantial distance from one another; and each said pair of support rollers being configured for making contact with and running on the running surface of the track.

9. The trolley of claim 8, wherein:

each said support roller defines a path of travel along the track; and a substantial portion of each said support roller projects, in a radial direction of each said support roller, beyond the corresponding vertical edge portion of its corresponding side and into the path of travel of a support roller of a different side, the radial direction being defined in a direction perpendicular to the axis of rotation of each said support roller and perpendicular to the corresponding vertical edge portion.

10. The trolley of claim 9, wherein said support rollers of each said pair of support rollers are disposed diagonally opposite one another on said roller cage.

11. The trolley of claim 10, wherein said trolley further comprises guiding means for laterally guiding said trolley.

12. The trolley of claim 11, wherein:

the track has a guiding surface;

said guiding means comprises at least four guide rollers for making contact with and running on the guiding surface of the track;

said trolley further comprises mounting means for supporting said at least four guide rollers;

said at least four guide rollers are mounted on said mounting means;

each of said at least four guide rollers is disposed on a corresponding vertical axle for rotating freely about said corresponding vertical axle; and said mounting means is disposed on said roller cage.

13. The trolley of claim 12, wherein:

said roller cage comprises a square base and four side portions extending from said square base;

said trolley further comprises stop means for restricting vertical movement of said trolley with respect to the track;

said trolley comprises a shaft which extends through the opening disposed in the bottom of the track, the opening having a width, and said shaft for being fixedly connected to the suspended panel, the system further comprising said stop means;

said stop means comprises a washer;

said washer is positioned directly below the track and has a dimension greater than the width of the opening disposed in the bottom of the track;

said washer is secured on said shaft by fastening means;

said fastening means comprises a nut and a screw;

said mounting means comprises a square plate;

each of said four guide rollers is disposed on a corner of said square plate; and said mounting means is disposed on said roller cage.

14. A trolley for a guiding system for moving suspended panels fixedly connected to said trolley running on a track having a first track portion, a second track portion transverse to and intersecting the first track portion, a running surface and an opening disposed in a bottom portion of the track, the opening having a width, said trolley further comprising:

four support rollers;

said four support rollers being the only support rollers of said trolley;

a roller cage for supporting said four support rollers and having at least one side surface with sides, said sides comprising two sets of opposite sides;

said four support rollers being mounted on said at least one side surface of said roller cage, wherein each of said four support rollers is disposed on a corresponding axle for rotating freely about said corresponding axle;

said four support rollers comprising two pairs of support rollers wherein one pair of said two pairs of support rollers is disposed on said opposite sides of each said set of opposite sides of said roller cage;

each said side has a corresponding vertical edge portion; each of said four support rollers is mounted on a corresponding one of said sides; a substantial portion of each of said four support rollers projects, in a radial direction of each said support roller, beyond the corresponding vertical edge portion of its corresponding side, the radial direction being defined in a direction perpendicular to said axis of rotation of each said support roller and perpendicular to the corresponding vertical edge portion; another portion of each of said four support rollers diametrically opposed to said substantial portion intersects with a plane which is coaxial with a vertical center axis of said roller cage and normal to said corresponding one of said sides;

each said support roller of each said pair of support rollers being configured for rotating about an axis of rotation;

said axes of rotation of each said pair of support rollers being parallel and displaced a substantial distance from one another; and each said pair of support rollers being configured for making contact with and running on the running surface of the track.

15. The trolley of claim 14, wherein:

a substantial portion of each said support roller projects, in a radial direction of each said support roller, beyond the corresponding vertical edge portion of its corresponding side and into the path of travel of a support roller of a different side, the radial direction being defined in a direction perpendicular to the axis of rotation of each said support roller and perpendicular to the corresponding vertical edge portion; and said support rollers of each said pair of support rollers are disposed diagonally opposite one another on the roller cage.

16. The trolley of claim 15, wherein said trolley further comprises guiding means for laterally guiding said trolley.

17. The trolley of claim 16, wherein the track has a guiding surface, and said guiding means comprises at least four guide rollers for making contact with and running on the guiding surface of the track.

18. The trolley of claim 17, comprising mounting means for supporting said at least four guide rollers and wherein;

said at least four guide rollers are mounted on said mounting means;

each of said at least four guide rollers is disposed on a corresponding vertical axle for rotating freely about said corresponding vertical axle; and said mounting means is disposed on said roller cage.

19. The trolley of claim 18, wherein:

said roller cage comprises a square base and four side portions extending from said square base;

said system further comprises stop means for restricting vertical movement of said trolley with respect to the track;

said trolley comprises a shaft which extends through the opening disposed in the bottom of the track, the opening having a width, and said shaft for being fixedly connected to the suspended panel;

said stop means comprises a washer;

said washer is positioned directly below the track and has a dimension greater than the width of the opening disposed in the bottom of the track;

said washer is secured on said shaft by fastening means;

said fastening means comprises a nut and a screw;

said mounting means comprises a square plate;

each of said four guide rollers is disposed in a corner of said square plate; and said mounting means is disposed on said roller cage.

20. The trolley of claim 19 wherein:

only a first pair of said two pairs of support rollers are for contacting the running surface along one of the first and second track portions on a track portion spaced away from the intersection of the track portions;

said first pair of said two pairs of support rollers being disposed parallel to a longitudinal direction of the track; and the other pair of said two pairs of support rollers being spaced apart from and disposed perpendicular to the longitudinal direction of the track at said track portion spaced away from the intersection of the track portions;

both pairs of said two pairs of support rollers are for contacting the running surface along the first and second track portions when said trolley is disposed at the intersection of the track portions;

said four side portions of said roller cage are perpendicular to said base of said roller cage;

said guide rollers are plastic;

said guide rollers are disposed above said support rollers;

said roller cage has a top portion wherein said mounting means is disposed on said top portion of said roller cage;

said mounting means is secured on said top portion of said roller cage by bolts;

said support rollers comprise ball bearings encased in plastic;

said base of said roller cage comprises a hole through which a first end of said shaft projects;

a shaft head is disposed above the mounting means for bracing a second end of the shaft; and two grooves are disposed in the bottom of the track, one of said grooves being disposed on each side of said opening disposed in the bottom of the track and between the running surface of the track and the opening, said two grooves being parallel to the opening.

* * * * *

UNITED STATES PATENT AND TRADEMARK OFFICE

CERTIFICATE OF CORRECTION

PATENT NO. : 5,295,281
DATED : March 22, 1994
INVENTOR(S) : Herbert KORDES

It is certified that error appears in the above-indentified patent and that said Letters Patent is hereby corrected as shown below:

In column 12, Claim 15, after line 17, begin a new paragraph by inserting the following:
--each said support roller defines a path of travel along the track;--

On the title page, item [63], after '18,', delete "1992" and insert --1991--.

In column 1, line 8, after '18,', delete "1992" and insert --1991--.

Signed and Sealed this

Fifteenth Day of April, 1997

Bruce Lehman

*Attest:*

BRUCE LEHMAN

*Attesting Officer*

*Commissioner of Patents and Trademarks*